US010513410B2

(12) United States Patent
Hoffmann

(10) Patent No.: US 10,513,410 B2
(45) Date of Patent: Dec. 24, 2019

(54) WINDING SHAFT FOR RECEIVING AT LEAST ONE WINDING CORE

(71) Applicant: Windmöller & Hölscher KG, Lengerich (DE)

(72) Inventor: Frank Hoffmann, Lengerich (DE)

(73) Assignee: Windmöller & Hölscher KG, Lengerich (DE)

( * ) Notice: Subject to any disclaimer, the term of this patent is extended or adjusted under 35 U.S.C. 154(b) by 13 days.

(21) Appl. No.: 15/580,545

(22) PCT Filed: Jun. 9, 2016

(86) PCT No.: PCT/EP2016/063214
§ 371 (c)(1),
(2) Date: Dec. 8, 2017

(87) PCT Pub. No.: WO2016/198549
PCT Pub. Date: Dec. 15, 2016

(65) Prior Publication Data

US 2018/0179019 A1 Jun. 28, 2018

(30) Foreign Application Priority Data

Jun. 9, 2015 (DE) ..... 10 2015 210 567

(51) Int. Cl.
*B65H 75/24* (2006.01)
*B65H 18/02* (2006.01)

(52) U.S. Cl.
CPC ..... *B65H 75/248* (2013.01); *B65H 18/028* (2013.01); *B65H 75/242* (2013.01); *B65H 2511/20* (2013.01); *B65H 2701/175* (2013.01)

(58) Field of Classification Search
CPC .. B65H 75/243; B65H 75/248; B65H 18/028; B65H 2701/175; B65H 2701/31;
(Continued)

(56) References Cited

U.S. PATENT DOCUMENTS 3,214,109 A * 10/1965 Gadde ..... B65H 75/243 242/571.2
3,552,672 A * 1/1971 Grettve ..... B65H 75/243 242/571.2
(Continued)

FOREIGN PATENT DOCUMENTS

DE 3425509 A1 1/1986
DE 9113939 U1 1/1992
(Continued)

OTHER PUBLICATIONS

PCT Notification of Transmittal of Translation of the International Preliminary Report of Patentability dated Dec. 21, 2017, issued for PCT Application No. PCT/EP2016/063214, as well as the English translation document, 9 pages.

*Primary Examiner* — William A. Rivera
(74) *Attorney, Agent, or Firm* — Rudy J. Ng; Bret E. Field; Bozicevic, Field & Francis LLP

(57) ABSTRACT

The invention relates to a winding shaft (1) for receiving at least one winding core, said winding shaft having a shaft body (2) made of fiber-reinforced plastic, preferably CFRP, having two bearing points (4, 5) at each end of the winding shaft, having radially displaceable clamping elements (20) distributed over the circumference and over the axial length for clamping, holding and releasing the winding cores. The winding shaft is designed to hold winding cores having an inside diameter of a maximum of 80 mm.

4 Claims, 1 Drawing Sheet

(58) Field of Classification Search
CPC ..... B65H 2511/20; B65H 2401/112; B65H 2401/231; B65H 2402/25; B65H 2404/41; B65H 2515/81; B65H 54/543
See application file for complete search history.

(56) References Cited

U.S. PATENT DOCUMENTS

| | | | | | |
|---|---|---|---|---|---|
| 3,904,143 | A * | 9/1975 | Kullander | B23B 31/305 | 242/571.2 |
| 5,379,964 | A | 1/1995 | Pretto et al. | | |
| 5,979,823 | A * | 11/1999 | Schlumpf | B65H 75/242 | 242/571.2 |
| 6,079,662 | A * | 6/2000 | Miller | B65H 75/243 | 242/530.3 |
| 2015/0298927 | A1* | 10/2015 | Findley | A61F 13/15764 | 242/559 |
| 2016/0229662 | A1* | 8/2016 | Hoffmann | B65H 75/243 | |

FOREIGN PATENT DOCUMENTS

| | | | |
|---|---|---|---|
| DE | 29510883 | U1 | 9/1995 |
| DE | 19738909 | A1 | 5/1998 |
| EP | 1043259 | A2 | 10/2000 |
| GB | 2329948 | A | 4/1999 |
| WO | WO2015055713 | A1 | 4/2015 |

* cited by examiner

WINDING SHAFT FOR RECEIVING AT LEAST ONE WINDING CORE

The invention relates to a winding shaft for receiving at least one winding core.

Plastic sheets, in particular those which were produced in a blown sheet layout or in a cast sheet layout, must be wound onto winding cores for transport and further processing. To this end winding cores are successively pushed onto winding shafts. Then, the provided winding shaft is transferred into a winding device in which a start is made to wind the plastic sheet onto the still empty winding cores.

The publication WO 2015/055713 A1 shows such a winding shaft for receiving at least one winding core. Such a winding shaft is disclosed there with a shaft body consisting of fiber-reinforces plastic, preferably of CFRP, with at least two bearing points at at least one end of the winding shaft, with clamping elements distributed over the circumference and over the axial length and which can be radially shifted for clamping, holding and releasing the winding core. A formation of folds frequently occurs during the winding on in this type of a winding shaft.

The publication GB 2 329 948 A discloses a device and a method for pre-centering and subsequent fastening winding cores on a winding shaft. This device comprises a pneumatic system for pre-centering and an additional, purely mechanical system for fastening the winding cores. This achieves a good centering of the winding cores but the device and the method are very complicated.

The publication DE 91 13 939 U1 also discloses a system for pre-centering and subsequently clamping winding cores on a winding shaft, wherein resiliently supported pressure pieces are provided for the pre-centering and wherein, for example, a pneumatic system is suggested for the clamping. Even this device and this method have a complicated construction and handling.

However, there is frequently the problem that the finished winding has an insufficient quality. In particular during the winding onto new cores the plastic sheet regularly forms folds.

The present invention therefore has the problem of producing sheet windings with an improved quality.

The invention solves this problem by all the features of Claim 1.

The present invention provides that the winding shaft comprises a shaft body of fiber-reinforced plastic, wherein preferably carbon fiber-reinforced plastic (CFRP) is provided. In addition, it is provided that at least two bearing points are arranged at at least one end of the winding shaft. The winding shaft is designed to hold winding cores with an inside diameter of a maximum of 80 mm. For different applications, winding cores have a standard measurement of 3 inches (relative to the inside diameter). They are, for example, winding cores for winding stretch sheeting with a thickness in the range of 10 to 30 micrometers, wherein cores are then used in automatic packaging machines or manually in order to provide loaded pallets with a secure load but also with protection against outside influences.

A winding shaft designed for winding cores with an inside diameter of a maximum of 80 mm has such a high degree of rigidity in the just-cited combination that oscillations co-responsible for the development of folds are reduced. The cited feature combination is especially advantageous if the working width, that is, the range in the axial direction of the winding shaft in which the winding cores can be placed is at least 1 m, preferably at least 1.5 m.

A winding shaft according to the invention comprises clamping elements distributed over the circumference and over the axial length which can be radially shifted for clamping, holding and releasing the winding cores.

The invention furthermore provides that clamping elements for pre-centering the winding core and clamping elements for clamping the winding core in the circumferential direction are provided and arranged in an alternating manner, wherein the clamping elements can be moved outward in the radial direction of the winding shaft, wherein the clamping elements comprise a widened base and can shift inside of openings, wherein the base can be shifted inside a widened groove, that hoses are provided for moving the clamping elements out which hoses are inserted between the widened groove and the base surface facing away from the particular clamping element and which can be filled with the gas and placed under pressure, wherein all hoses can be loaded from a central compressed gas pipe with gas, wherein all hoses are connected by a connection line to the central compressed gas pipe, and that a throttle device is provided or the clamping elements can be loaded with a spring force for the clamping in order to delay the movement of the clamping elements for clamping relative to the movement of the clamping elements for the pre-centering.

Preferably at least six rows of clamping elements are provided, viewed in the circumferential direction, wherein approximately one half of them are suitable for pre-centering the winding shafts (pre-centering elements), wherein the other clamping elements are provided with holders of the winding cores. The clamping of a winding core then takes place as follows: At first, the clamping elements for pre-centering, that is, the pre-centering elements, can be moved outward in the radial direction of the winding shaft up to a few tenths of a millimeter below the nominal diameter of the winding core. As a result, the winding core is not contacted by all these clamping elements but rather a slot remains which is very small or there is a slight touching contact. Therefore, the core, which preferably consists of cardboard and/or paper, is almost centered, wherein the main inertial axes of the core and of the winding shaft are almost in alignment. Then, the clamping elements for holding the winding core can be moved outward. Subsequently, the winding core is firmly clamped onto the winding shaft. Since the last-cited clamping elements slightly press the winding core locally outward, the free areas migrate readily inward, so that the clamping elements for pre-centering now all make contact with the winding core and exert an additional support and holding action.

In order to push winding cores on, the clamping elements can be located completely inside the winding shaft, i.e., their outer surfaces do not project above the outside surface of the winding shaft.

It is achieved by these components and by this procedure that the winding core achieves an almost ideal round course in the winding device, which noticeably reduces the formation of folds. This allows the winding quality to be considerably raised.

The winding shaft according to the invention entails special advantages in combination with a winding device which winds on the sheet produced on a cast sheet layout inline, that is, without intermediate storage, wherein the production rate is 500 to 700 meters per minute (m/min) since the optimal positioning of the winding core has an especially positive effect here.

In an advantageous embodiment the winding shaft is designed with an inside core diameter of 2 inches, as a result of which the advantages of the winding shaft according to the invention are even more effective.

The clamping elements arranged in series, viewed in the axial direction of the winding shaft, have an interval and are therefore interrupted. The providing of an interval serves the purpose that the greatest possible stability of the fiber-reinforced material is achieved. Therefore, in the case of clamping elements which are spaced from each other, fewer fibers have to be separated than in the case of continuous clamping elements. The interval of two clamping elements located in series is at least 50 mm, preferably 100 mm and that the most 200 mm so that winding cores with a standard length of 250 mm can be positioned as desired without the clamping force being appreciably reduced.

It is advantageous if such winding cores can be placed on the winding shaft which have a standard length of 250 mm or more. In this case the winding cores can be held with a sufficient number of clamping elements so that an ideal round course is achieved.

Two series of clamping elements which are adjacent viewed in the circumferential direction are preferably offset in the axial direction so that the stability of the winding shaft is increased again, which again has a positive effect on the winding quality.

Other advantages, features and details of the invention are apparent from the following description in which different exemplary embodiments are explained in detail with reference made to the figures. The features mentioned in the claims and in the specification can be essential for the invention individually or in any combinations. Features and details described in conjunction with the method according to the invention in the scope of the entire disclosure are of course also valid in conjunction with the winding shaft according to the invention and inversely, so that as regards the disclosure regarding the individual aspects of the invention, mutual reference is made and can be made. In the individual figures:

Figure 1:
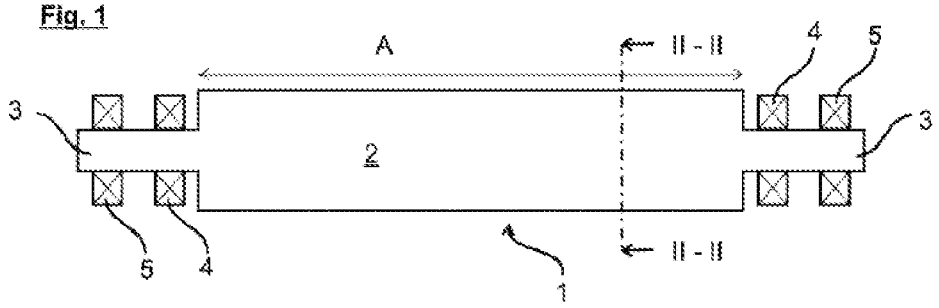
FIG. 1 shows a lateral view of a winding shaft according to the invention.

FIG. 1 shows a lateral view of a winding shaft 1. This winding shaft comprises a winding shaft body 2 which has the working width A, which is made clear by the double arrow. The winding shaft 1 comprises a pin 3 on each of its ends which is rotatably supported in two bearing points 4, 5. These bearing points can comprise known roller bearings or ball bearings. In order to replace the winding cores, which are not sketched into this figure, one end of the winding shaft 1 can be freed, or the winding shaft 1 can be removed from the winding device. The bearing points 4, 5 can remain completely or partially on the winding shaft or in the winding device.

Figure 2:
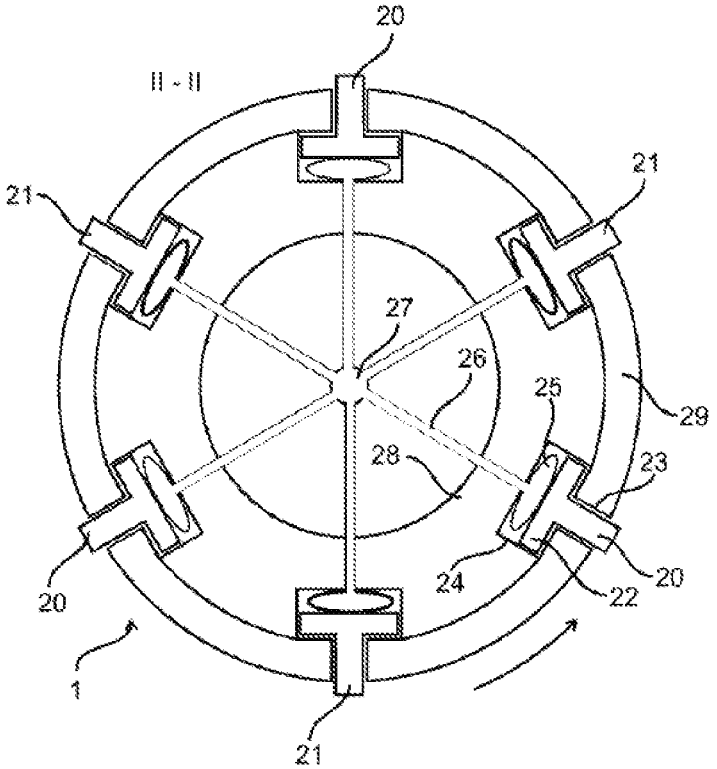
FIG. 2 shows section II-II from FIG. 1.

FIG. 2 shows section II-II from FIG. 1. At first, the clamping elements 20 and 21 can be recognized, wherein the clamping elements 20 are provided for pre-centering (pre-centering elements) in the clamping elements 21 for clamping. The clamping elements 20 and 21 are arranged alternatingly viewed in the circumferential direction φ. Three clamping elements 20 and 21 each can be recognized in the present exemplary embodiment. However, in general, even more clamping elements 20 and/or 21 can be provided in order to achieve an even better round course. The construction of the clamping elements is described further below. The clamping elements 20 and 21 can be connected to a broadened base 22 or can be constructed in one piece with the latter and can be shifted inside the opening 23 so that they can assume different radial positions. The base 22 can be shifted in the radial direction inside a broadened groove 24. The broadened groove 24 also serves as a path limitation so that the winding core can be held with great force but it cannot be excessively pressed out of the cylindrical shape with too great a regulating distance.

The moving out of the clamping elements takes place in the exemplary embodiment shown by at least one hose 25 inserted between the widened groove 24 and the surface of the base 22 facing away from the clamping element 20, 21, which hose is filled with a gas, in particular with air, and can be put under pressure. All hoses area connected for this by a connection line 26 to a central compressed gas pipe 27 which can preferably be supplied via a rotary leadthrough from outside the winding shaft with a gas standing under pressure.

In order to now clamp one or more winding cores onto the winding shaft, the central compressed gas pipe 27 is loaded with a gas which passes into the hoses. These hoses 25 expand and therefore press the clamping elements 20, 21 outward. In order to bring it about that the clamping elements 21 are later activated as the clamping elements 20 or that the clamping elements 21 move slower than the clamping elements 21, a throttle device is provided which can be realized in many ways. A simple possibility is to keep the decisive cross section of the connection lines 26 for the clamping elements 21 smaller than the cross section of the connection lines 26 for the clamping elements 20. Another possibility is to provide the hoses for the clamping elements 21 with a lesser elasticity than the hoses for the clamping elements 20. This situation is clarified in FIG. 2 in that the hoses for the clamping elements 21 have a greater line width than the hoses for the clamping elements 20. Both previously cited measures have the result that the hoses for the clamping elements 21 expand slower under a continuous gas supply than the hoses for the clamping elements 20. Many other throttle elements are conceivable.

Even other or additional measures and devices are conceivable for the delayed movement of the clamping elements 21. Thus, the clamping elements 21 can be loaded with a spring force that must be overcome before shifting these clamping elements. However, even mechanical adjusting means can be provided. Thus, axially running eccentric shafts can be provided for shifting the adjustment elements. These shafts can all be adjusted at the same time but the eccentricity for the clamping elements 21 can be designed in such a manner that the clamping elements 21 are moved later than the clamping elements 20.

Figure 3:
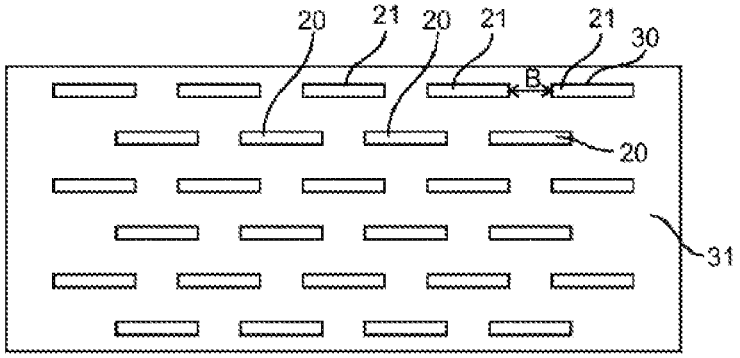
FIG. 3 shows the development of the circumferential surface of the winding shaft.

The winding shaft body 2 can preferably be manufactured in the following manner At first, a tubular base body 28 is manufactured, wherein one of the following known methods can be used: Pultrusion method, winding method (filament winding), or the rolling up of non-woven fabrics. A combination of these methods can also be used. The widened grooves 24 are subsequently introduced into the base body 28, after which the outer pipe 29 is manufactured, preferably again using one of the above-cited manufacturing methods. Then the openings 23 are introduced above the widened grooves which openings preferably have the shape of oblong holes 30 (FIG. 3). Several oblong holes are arranged in a row, wherein the interval B of each two oblong holes is preferably in the range between 50 and 200 mm.

After the manufacture of the openings 23 and of the oblong holes 30, the clamping elements 20, 21 and the hoses are introduced via an open frontal side of the winding shaft 1, wherein the clamping elements can be present individually or as components of a clamping strip running in the axial direction.

FIG. 3 shows a development of the circumferential surface 31 of the winding shaft 1. The row-shaped arrangement of the clamping elements 21 and 20 can now be recognized. Furthermore, an offset of the clamping elements 20 opposite the clamping elements 21 in the axial direction can be recognized, wherein the number of clamping elements 20 is preferably less than the number of clamping elements 21 since lesser demands are put on the clamping elements 20 for the pre-centering as regards the transfer of force than on the clamping elements 21 for the clamping.

Every two clamping elements 20 or each two clamping elements 21 are arranged with an interval B from one another. Preferred measurements for these intervals were already indicated in the general description.

| List of reference numerals | |
|---|---|
| 1 | Winding shaft |
| 2 | Winding shaft body |
| 3 | Pin |
| 4 | Bearing point |
| 5 | Bearing point |
| 20 | Clamping element |
| 21 | Clamping element |
| 22 | Widened base |
| 23 | Opening |
| 24 | Widened groove |
| 25 | Hose |
| 26 | Connection line |
| 27 | Compressed gas pipe |
| 28 | Tubular base body |
| 29 | Outer pipe |
| 30 | Oblong hole |
| 31 | Circumferential surface |

The invention claimed is:

1. A winding shaft for receiving at least one winding core with the shaft body consisting of fiber-reinforced plastic with at least two bearing points at least one end of the winding shaft with clamping elements distributed over the circumference and over the axial length which can be radially shifted for clamping, holding and releasing the winding cores, wherein the winding shaft is arranged to hold winding cores with an inside diameter of a maximum of 80 mm, that clamping elements for pre-centering the winding core and clamping elements for clamping the winding core in the circumferential direction are provided and arranged in an alternating manner, wherein the clamping elements can be moved outward in the radial direction of the winding shaft, wherein the clamping elements comprise a widened base and can shift inside of openings, wherein the base can be shifted inside a widened groove, that hoses are provided for moving the clamping elements out which hoses are inserted between the widened groove and the base surface facing away from the particular clamping element and which can be filled with the gas and placed under pressure, wherein all hoses can be loaded from a central compressed gas pipe with gas, wherein all hoses are connected by a connection line to the central compressed gas pipe, and that a throttle device is provided or the clamping elements can be loaded with a spring force for the clamping in order to delay the movement of the clamping elements for clamping relative to the movement of the clamping elements for the pre-centering, wherein approximately one half of the clamping elements are suitable for pre-centering.

2. The winding shaft according to claim 1, wherein at least two bearing points are provided on both ends of the winding shaft.

3. A method for clamping at least one winding core onto a winding shaft according to claim 1, in which at first clamping elements for pre-centering are moved out in the radial direction of the winding shaft to a maximum of nine tenths of a millimeter below the nominal direction of the winding core so that a slot remains or there is a slight touching contact between the pre-centering element and the winding core, and subsequently clamping elements are moved outward for clamping the winding core.

4. The winding shaft according to claim 1, wherein the fiber-reinforced plastic is carbon fiber-reinforced plastic (CFRP).

* * * * *